US008602501B2

(12) United States Patent
Walker et al.

(10) Patent No.: US 8,602,501 B2
(45) Date of Patent: Dec. 10, 2013

(54) BACKREST

(75) Inventors: Brock Walker, Okemos, MI (US); John C. Groelsma, Jenison, MI (US); John F. Aldrich, Grandville, MI (US)

(73) Assignee: Herman Miller, Inc., Zeeland, MI (US)

( * ) Notice: Subject to any disclaimer, the term of this patent is extended or adjusted under 35 U.S.C. 154(b) by 110 days.

(21) Appl. No.: 13/228,696

(22) Filed: Sep. 9, 2011

(65) Prior Publication Data

US 2012/0062014 A1 Mar. 15, 2012

Related U.S. Application Data

(60) Provisional application No. 61/382,759, filed on Sep. 14, 2010.

(51) Int. Cl.
*A47C 7/02* (2006.01)
*A47C 7/16* (2006.01)

(52) U.S. Cl.
USPC ..... 297/452.15; 297/452.14; 297/452.29; 297/452.31; 297/452.65

(58) Field of Classification Search
USPC ..... 297/285–299, 300.1–309, 452.14, 297/452.15, 452.31, 452.65, 452.29, 452.3
See application file for complete search history.

(56) References Cited

U.S. PATENT DOCUMENTS 4,123,105 A * 10/1978 Frey et al. ..... 297/452.14 X
4,626,029 A 12/1986 Brauning
4,744,603 A * 5/1988 Knoblock ..... 297/285 X
4,776,633 A * 10/1988 Knoblock et al. ... 297/452.15 X
4,783,121 A 11/1988 Luyk et al.
4,834,453 A * 5/1989 Makiol ..... 297/300.4
4,856,846 A * 8/1989 Lohmeyer ..... 297/285
4,892,356 A * 1/1990 Pittman et al. ..... 297/452.15
5,050,931 A * 9/1991 Knoblock ..... 297/285 X
5,102,196 A * 4/1992 Kaneda et al. ..... 297/452.15
5,286,083 A 2/1994 Mattison
5,318,346 A * 6/1994 Roossien et al. ..... 297/452.15 X
5,338,099 A 8/1994 Ishi et al.
5,487,591 A * 1/1996 Knoblock ..... 297/452.14
5,499,859 A * 3/1996 Angell ..... 297/452.65 X
5,540,481 A * 7/1996 Roossien et al. ..... 297/300.4
5,567,012 A * 10/1996 Knoblock ..... 297/303.3
5,582,459 A * 12/1996 Hama et al. ..... 297/285 X
5,611,598 A * 3/1997 Knoblock ..... 297/452.15 X
5,662,381 A * 9/1997 Roossien et al. ..... 297/452.15 X
5,671,977 A 9/1997 Jay et al.
5,725,277 A * 3/1998 Knoblock ..... 297/452.15 X
5,806,930 A * 9/1998 Knoblock ..... 297/300.1

(Continued)

FOREIGN PATENT DOCUMENTS

EP 1 698 255 A1 9/2006
JP 07100031 A 4/1995
WO WO 2004/039214 A2 5/2004

*Primary Examiner* — Rodney B White
(74) *Attorney, Agent, or Firm* — Brinks Gilson & Lione

(57) ABSTRACT

A backrest includes a shell having a first, forwardly facing support surface being more pronounced along upper and lower portions of a central, spine region relative to a middle portion of the central spine region and relative to side regions adjacent the central, spine region. A cushion is disposed over the first support surface. In one aspect, the cushion has a second, forwardly facing support surface being free of any corresponding pronounced portions overlying the pronounced upper and lower portions of the central, spine region of the underlying shell. In another aspect, a chair includes a backrest as disclosed. Methods of use and assembly also are provided.

26 Claims, 5 Drawing Sheets

(56) References Cited

U.S. PATENT DOCUMENTS

| | | | | |
|---|---|---|---|---|
| 5,836,025 | A | 11/1998 | Poncy, Sr. | |
| 5,951,110 | A * | 9/1999 | Conner et al. | 297/452.31 |
| 6,168,239 | B1 * | 1/2001 | Conner et al. | 297/452.31 |
| 6,386,634 | B1 | 5/2002 | Stumpf et al. | |
| 6,409,268 | B1 * | 6/2002 | Cvek | 297/452.15 X |
| D462,210 | S | 9/2002 | Chou et al. | |
| 6,755,467 | B1 | 6/2004 | Chu | |
| 7,032,971 | B2 | 4/2006 | Williams | |
| 7,040,706 | B2 | 5/2006 | Koffler | |
| 7,140,057 | B2 | 11/2006 | Hetzel et al. | |
| 7,399,036 | B2 | 7/2008 | Kowal et al. | |
| 7,445,292 | B2 | 11/2008 | Moule | |
| 7,604,292 | B1 | 10/2009 | Reading | |
| 7,604,298 | B2 | 10/2009 | Peterson et al. | |
| 7,607,738 | B2 | 10/2009 | Gregory et al. | |
| 7,611,199 | B2 * | 11/2009 | Michalak et al. | 297/300.2 |
| 2004/0056527 | A1 | 3/2004 | Lance et al. | |
| 2004/0100139 | A1 | 5/2004 | Williams | |
| 2009/0127905 | A1 | 5/2009 | Schmitz et al. | |
| 2010/0244521 | A1 * | 9/2010 | Ueda | 297/298 |
| 2012/0205952 | A1 * | 8/2012 | Takeuchi et al. | 297/300.1 |

* cited by examiner

BACKREST

This application claims the benefit of U.S. Provisional Application No. 61/382,759, filed Sep. 14, 2010, the entire disclosure of which is hereby incorporated herein by reference.

FIELD OF THE INVENTION

The present invention relates generally to a backrest, and in particular, to a backrest having various regions of pronounced support that are visually masked by a cushion, together with methods of use and assembly thereof.

BACKGROUND

Seating structures, such as office chairs, are often configured with backrests to support the back of a user. In many embodiments, the backrest may include a shell covered with a cushion, such as a foam pad, that does not provide targeted support for various parts of the user's back, thereby leading to fatigue, soreness and other maladies over prolonged use. In response, various devices, such as lumbar and sacral supports, may be configured to provide targeted, ergonomic support for the user. Typically, such devices, or at least portions thereof, are exterior to the backrest, or are readily apparent to the user. This in turn may detract from the aesthetics of the seating structure. In addition, some seating structures may be configured with contoured cushions targeting various support configurations. Such structures, however, may again detract from the aesthetics, which are defined by the requisite shape, and may not provide sufficient support to the user through the cushion alone. In addition, such structures typically provide for relief along the spine, for example by having a forward concave support, rather than providing a pronounced support for the spine, which may not provide a desired visual aesthetic to the user.

SUMMARY

The present invention is defined by the following claims, and nothing in this section should be considered to be a limitation on those claims.

In one aspect, one embodiment of a backrest includes a shell having a first, forwardly facing support surface being more pronounced along upper and lower portions of a central, spine region relative to a middle portion of the central spine region and relative to side regions adjacent the central, spine region. A cushion is disposed over the first support surface. The cushion has a second, forwardly facing support surface being free of any corresponding pronounced portions overlying the pronounced upper and lower portions of the central, spine region of the underlying shell. In another aspect, a chair includes a backrest as disclosed.

In one embodiment, a central, spine region of a backrest includes vertically spaced upper, middle and lower portions, with the upper portion including at least a first protuberance extending forwardly from a support surface, and the lower portion including at least a second protuberance extending forwardly from the support surface. The cushion has a surface contour configured to visually disguise the first and second protuberances wherein the surface of the cushion is substantially free of any protuberances overlapping the first and second protuberances.

In another aspect, a method of supporting a back of a user includes viewing a front surface of a backrest cushion on a seating structure without discerning any apparent, pronounced support along a central, spine region of the front surface, sitting in the seating structure and pressing against the front surface of the backrest cushion, and providing a pronounced support to an upper and lower portion of the user's spine.

The various embodiments of the backrest, chair, and methods of using and assembling the backrest, provide significant advantages over other backrests and seating structures. For example and without limitation, the spine of the user may be supported in various targeted regions without having to provide an auxiliary, external device. In addition, the outer contour of the cushion is not dictated by support constraints, since the underlying shell provides a targeted, pronounced support. In this way, the visual design of the backrest may be altered to provide different aesthetics without diminishing the supportive capabilities of the backrest.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

It should be understood that the term "plurality," as used herein, means two or more. The term "longitudinal," as used herein means of or relating to length or the lengthwise direction, and in general corresponds to a direction running between a top and bottom, for example from a top of a backrest to a bottom thereof. The term "lateral," as used herein, means situated on, directed toward or running from side to side. The term "coupled" means connected to or engaged with whether directly or indirectly, for example with an intervening member, and does not require the engagement to be fixed or permanent, although it may be fixed or permanent, and includes both mechanical and electrical connection. The terms "first," "second," and so on, as used herein are not meant to be assigned to a particular component so designated, but rather are simply referring to such components in the numerical order as addressed, meaning that a component designated as "first" may later be a "second" such component, depending on the order in which it is referred. It should also be understood that designation of "first" and "second" does not necessarily mean that the two components or values so designated are different, meaning for example a first surface may be the same as a second surface, with each simply being applicable to different components.

Figure 2:
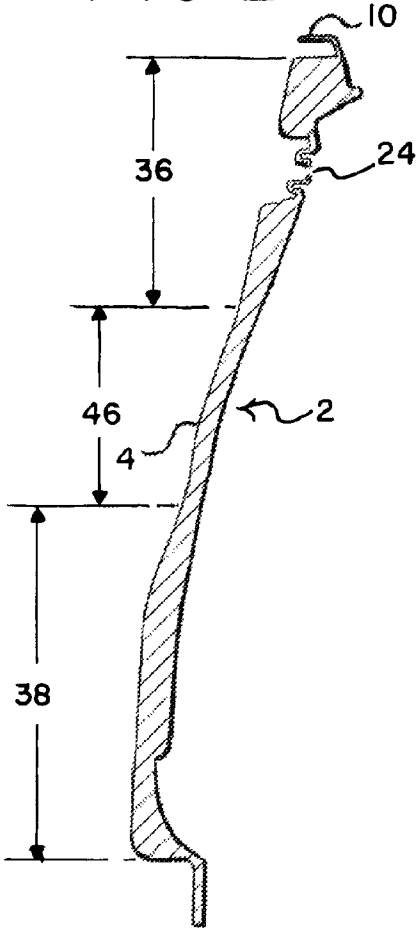
FIG. 2 is a cross-sectional view of the backrest shell taken along line 2-2 of FIG. 1.
Figure 1:
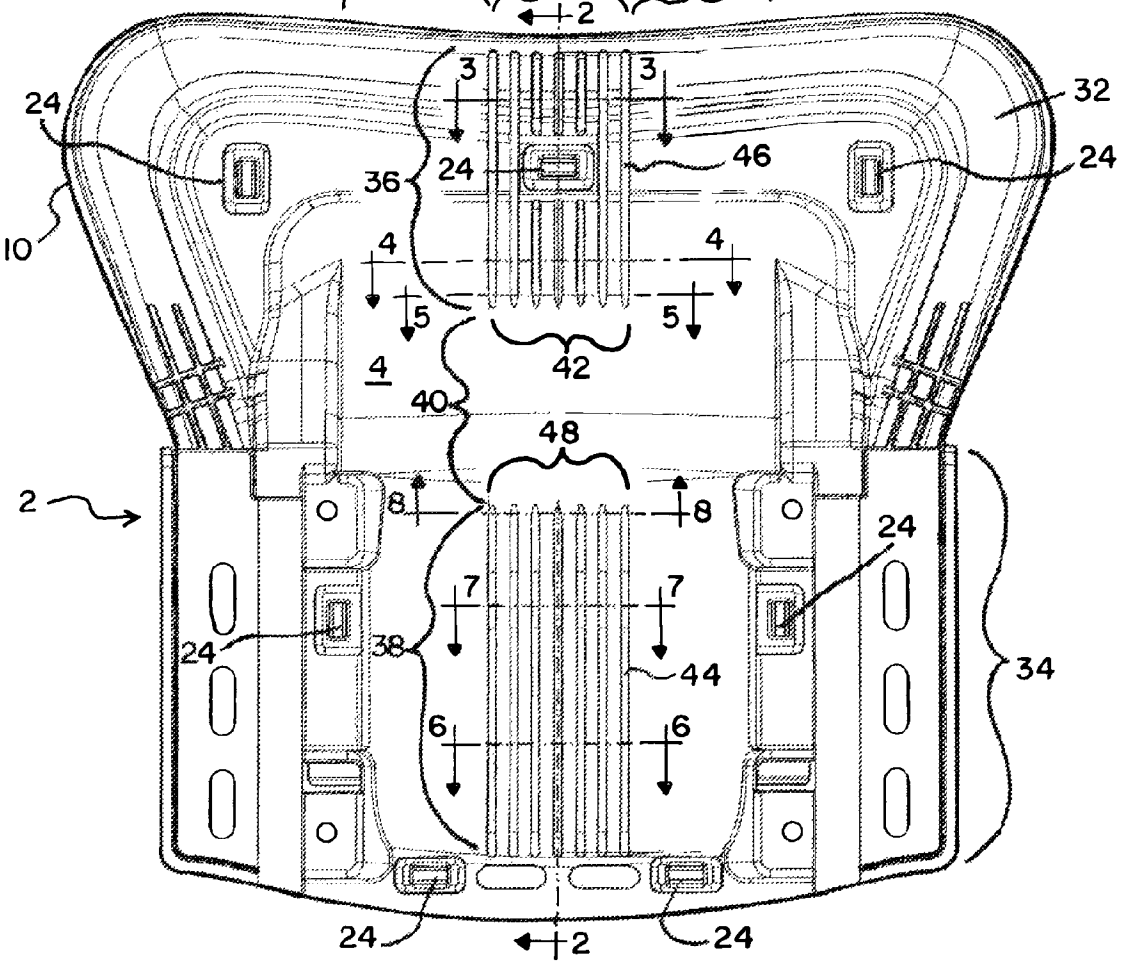
FIG. 1 is a front view of one embodiment of a backrest shell.
Figure 3:
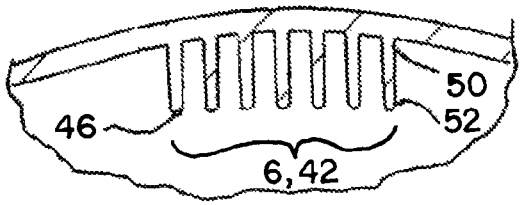
FIG. 3 is a cross-sectional view of the backrest shell taken along line 3-3 of FIG. 1.
Figure 4:
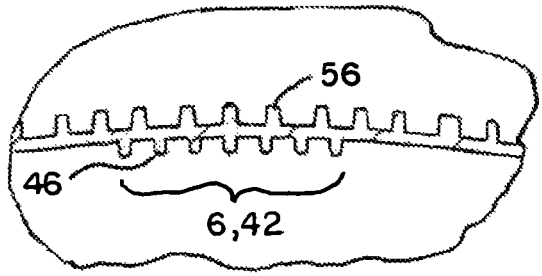
FIG. 4 is a cross-sectional view of the backrest shell taken along line 4-4 of FIG. 1.
Figure 5:
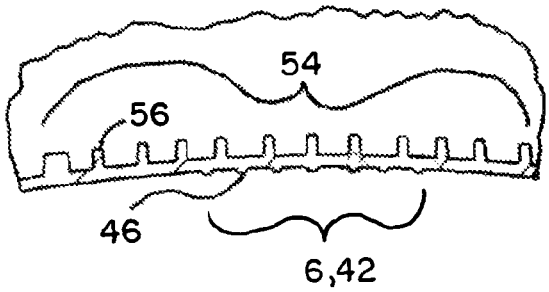
FIG. 5 is a cross-sectional view of the backrest shell taken along line 5-5 of FIG. 1.
Figure 10:
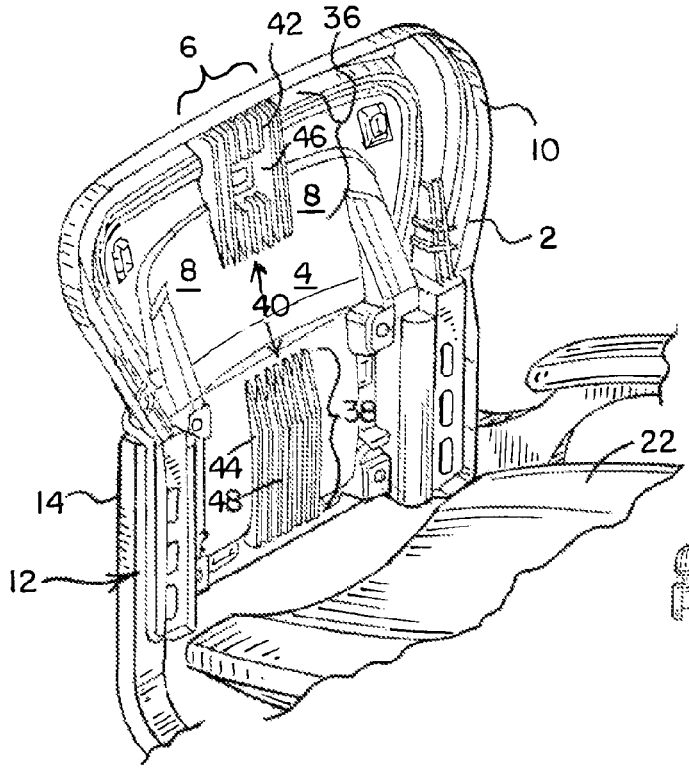
FIG. 10 is a partial perspective view of chair having a backrest without a cushion.
Figure 11:
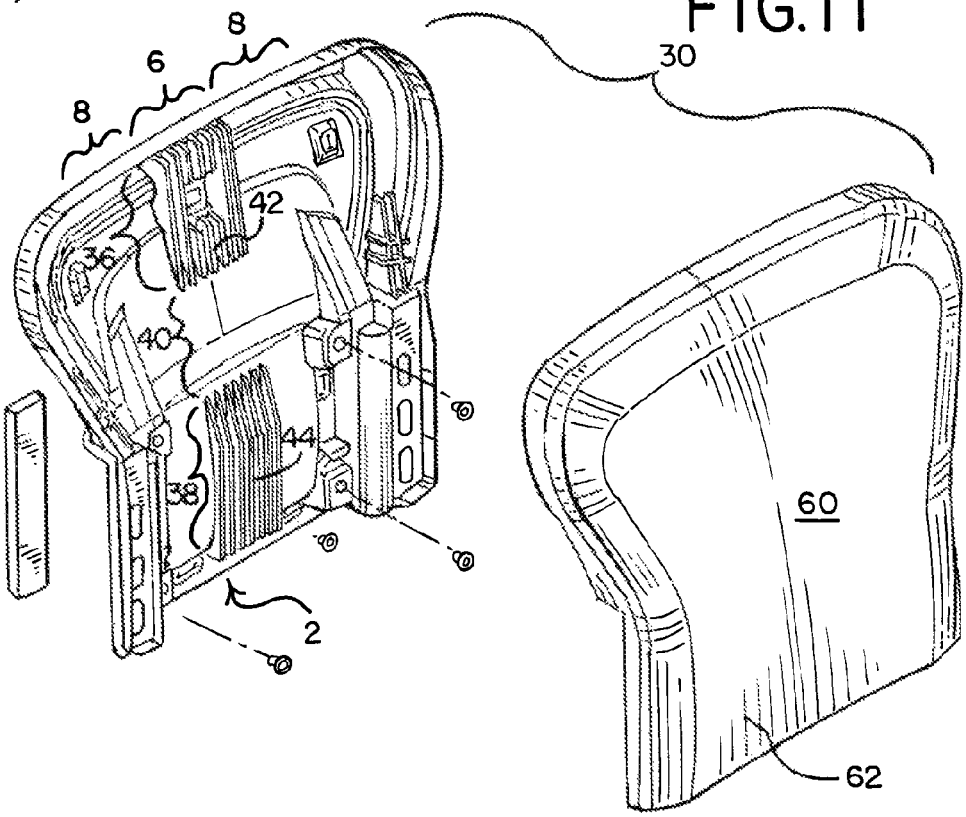
FIG. 11 is an exploded perspective view of a backrest assembly.
Figure 13:
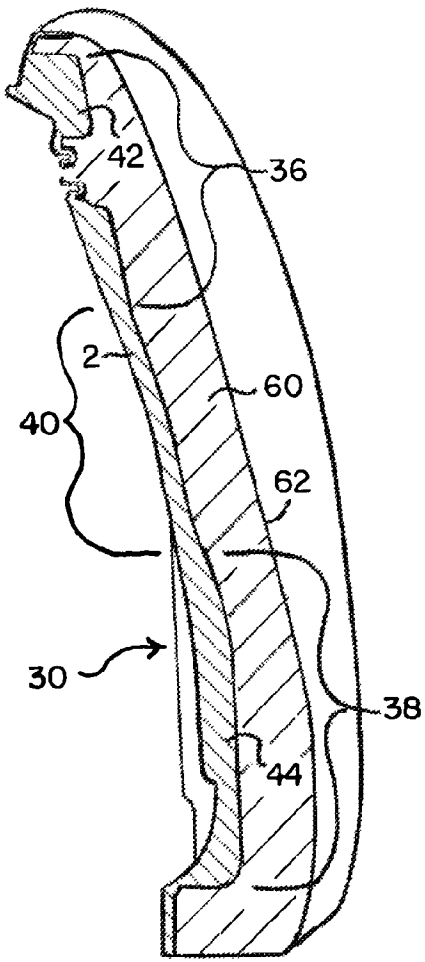
FIG. 13 is a cross-sectional view of the backrest assembly taken along line 13-13 of FIG. 12.
Figure 12:
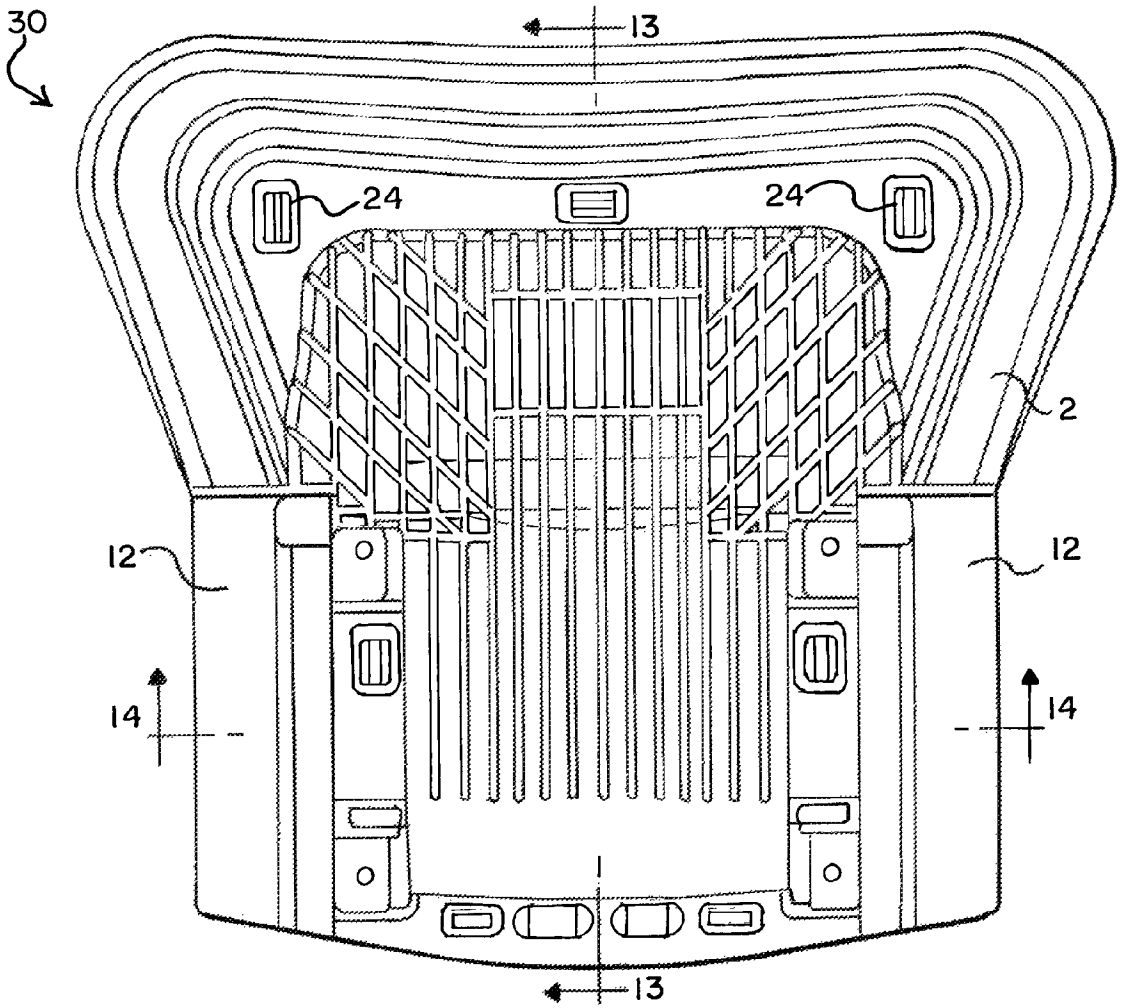
FIG. 12 is a rear view of a backrest assembly shown in FIG. 11.
Figure 14:
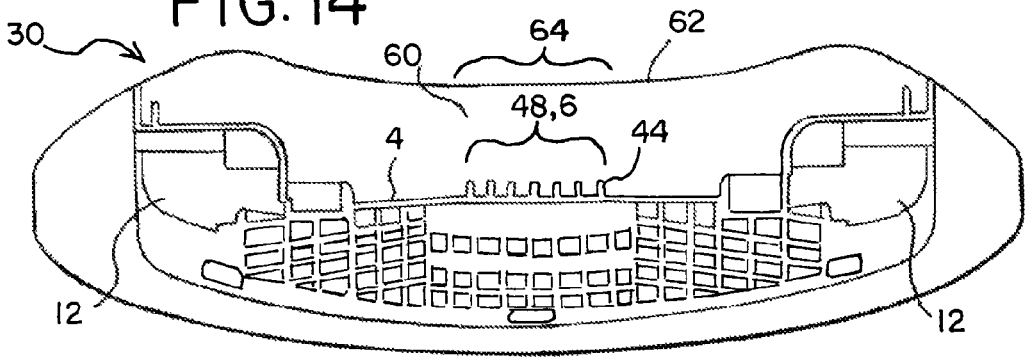
FIG. 14 is a cross-sectional view of the backrest assembly taken along line 14-14 of FIG. 12.
Figure 15:
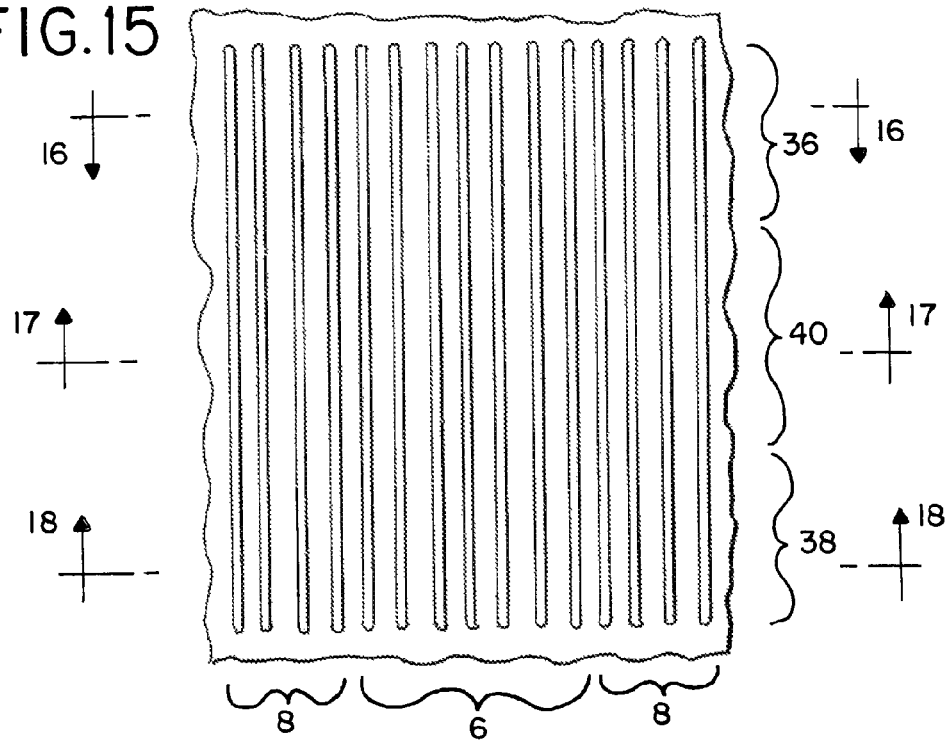
FIG. 15 is a front view of an alternative embodiment of a backrest shell.
Figure 16:
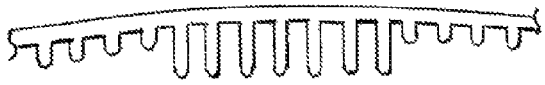
FIG. 16 is a cross-sectional view of the backrest shell taken along line 16-16 of FIG. 15.
Figure 17:
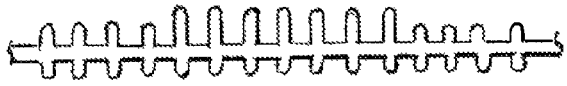
FIG. 17 is a cross-sectional view of the backrest shell taken along line 17-17 of FIG. 15.
Figure 18:
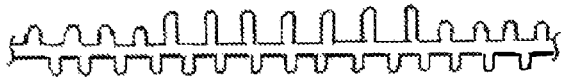
FIG. 18 is a cross-sectional view of the backrest shell taken along line 18-18 of FIG. 15.

Referring to FIGS. 1-8, 10, 11 and 14, a backrest shell 2 includes a forwardly facing support surface 4. The backrest shell is preferably made of injection molded plastic, or alternatively, of molded fiberglass, formed sheet metal, molded plywood, or combinations thereof. A central, spine region 6 thereof extends longitudinally from a top to a bottom of the shell 2. The shell further includes recessed side regions 8 disposed on opposite sides of the central, spine region 6. A rim 10 extends around the outer periphery of the shell and defines a recess, which is shaped to receive portions of a cushion 60 in one embodiment so as to form a backrest assembly 30 as shown in FIGS. 9 and 11-14. Referring to FIGS. 9-11, a pair of sockets 12 is formed on the outer portions of the backrest. The sockets 12 are shaped to received uprights 14 from a backrest frame member, which is pivotally attached to a control housing 16 or base of a chair 18 as shown in FIGS. 9 and 10. The chair further includes a seat 22, which may be pivotally connected to one or both of the control housing 16 and/or backrest frame member with a linkage 20. It should be understood that the backrest may be incorporated into seating structures besides the chair shown, including various residential and vehicular seating structures, for example with fixed and/or non-tiltable seats and backrests. Referring to FIGS. 1, 11 and 12, a plurality of openings 24 are formed in the shell to receive fasteners that secure a back panel. The backshell 2 has outer wing portions 32 that extend laterally outwardly from a lower portion 34.

Vertically spaced upper and lower upper portions 36, 38 of the central, spine region are more pronounced than a middle portion 40 of the central, spine region. As used herein, the term "pronounced" refers to a structure that is prominent and distinct, or stands out or projects from the surrounding structure, and/or refers to providing a more distinct or definite support than the surrounding structure.

For example, in one preferred embodiment, the upper portion 36 of the central spine region is configured with at least one forwardly extending protuberance 42, shown in one embodiment as a plurality of horizontally spaced ribs 46. Although shown as seven (7) ribs, the protuberance may be formed from a single rib, some number greater than seven, or any number therebetween. For example, the entire upper portion 36 may be formed as a forwardly extending bump. The lower portion 38 of the central spine region also is configured with at least one forwardly extending protuberance 48, shown in one embodiment as a plurality of horizontally spaced ribs 44. Although shown as seven (7) ribs, the protuberance may be formed from a single rib, some number greater than seven, or any number therebetween. For example, the entire lower portion may be formed as a forwardly extending bump. In one embodiment, the middle portion 40 of the central spine region, and the side regions 8 immediately adjacent the central, spine region are relatively smooth, without any protuberances, such that the upper and lower portions 36, 38 stand out from the support surface 4. Of course, it should be understood that the middle portion 40 of the central spine region 6 and the side regions 8 may include protuberances, but that they are preferably less pronounced than the upper and lower portions, as shown in FIGS. 15-18. In addition, the protuberances in the middle spine region may be more, or less, pronounced than the protuberances in the side regions In one embodiment, the ribs 46 of the upper portion 36 are tapered from a base 50 to a free edge 52 thereof, for example with respective dimensions of 0.189 inches and 0.158 inches. In one embodiment, the support surface 4 has a forwardly facing concave contour, with a protuberance along the lateral centerline having a maximum depth of about 1.016 inches. In one embodiment, the free edges 52 of the ribs are substantially coplanar. The depth of the ribs varies and transitions to zero (0.00) along the longitudinal direction, having depths, in one embodiment, of about 0.192 inches (width of about 0.157 inches) in FIG. 4 and of about 0.54 inches (width of about 0.163 inches) in FIG. 5. Of course, it should be understood that other thicknesses and depths may be suitable.

Figure 6:
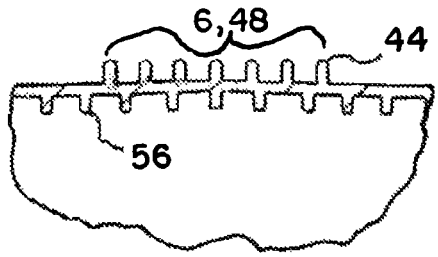
FIG. 6 is a cross-sectional view of the backrest shell taken along line 6-6 of FIG. 1.
Figure 7:
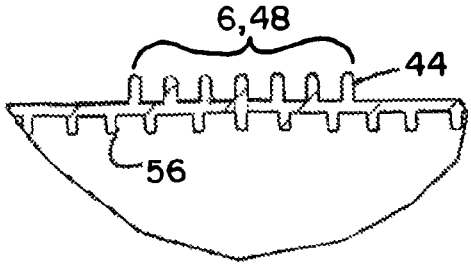
FIG. 7 is a cross-sectional view of the backrest shell taken along line 7-7 of FIG. 1.
Figure 8:
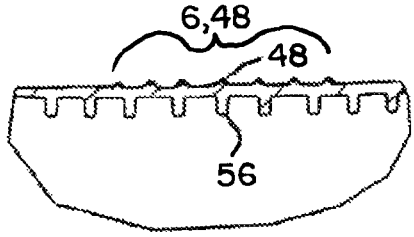
FIG. 8 is a cross-sectional view of the backrest shell taken along line 8-8 of FIG. 1.
Figure 9:
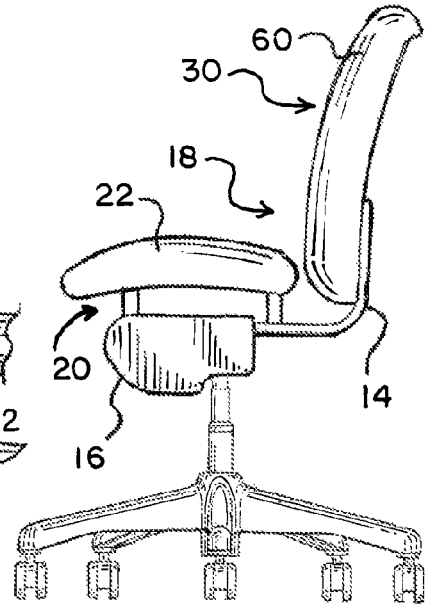
FIG. 9 is a schematic side view of a chair with a backrest including a cushion.

Likewise, the ribs 44 of the lower portion have varying depths, which transition for example from 0.280 inches (width of about 0.153 inches) in FIG. 6 to 0.355 inches (width of about 0.154 inches) in FIG. 7 and back to 0.036 inches (width of about 0.144 inches) in FIG. 8, and finally to 0.00 inches at the middle portion. Again, other depths and widths may be suitable.

The overall width of the central, spine region 6 is preferably less than about 4.00 inches, and more preferably less than about 3.50 inches, or between about 2.5 and 3.5 inches, and preferably about 3 inches. In one embodiment, the upper portion 36 has a length of about 4 and 6 inches, and more preferably between about 5 and 5.50 inches, and preferably about 5.30 inches. Of course, other lengths may be suitable. In embodiment, the lower portion 38 has a length of between about 5 and 9 inches, and more preferably between about 6 and 9 inches, and preferably about 7.50 inches. Of course, other lengths may be suitable. In one preferred embodiment, the upper portion 36 is more pronounced, or has a greater depth, than the lower portion 38.

In one embodiment, protuberances 54, configured as ribs 56 in one embodiment, also extend rearwardly from the shell. The protuberances extend laterally outwardly beyond the central, spine region 6 of the front side of the backrest shell, and also are located on a backside of the middle portion 40.

Referring to FIGS. 9-14, a cushion 60 is disposed over the support surface of the shell and is secured to the shell 2, for example by overmolding the foam 60 on the shell 2. The cushion 60 has a support surface 62 with a predetermined contour. In one embodiment, the contour is free of any pronounced portions corresponding to the underlying corresponding pronounced portions of the backrest shell, meaning the contour may not have any pronounced portions whatsoever, or alternatively, the contour may have pronounced portions positioned over the underlying pronounced portions of the backrest shell, but to a lesser degree, for example with a lesser depth. In various embodiments, the cushion is made of office support foam, or other suitable compressible materials or cushioning material such as polyurethane foam, non-woven fiber, latex foam, or combinations thereof. In one embodiment, the support surface 62 has a generally concave shape.

In use, the user may view a front support surface 62 of the cushion 60 without discerning any apparent, pronounced support along a central, spine region 64 of the front surface thereof. The user may thereafter sit in the seating structure and press against the front support surface 62 of the backrest cushion. In doing so, the cushion compresses, with the pronounced structure 42, 48 along the upper and lower portions 36, 38 of the backshell providing a more rigid support than the middle portion 40 or the adjacent side regions 8. In this way, the upper and lower portions of the user's spine are provided with a more pronounced support as the user leans or tilts rearwardly in the seating structure. The targeted support for the regions of the user's spine are integral to the backrest structure, and are not dependent on the contour or differentiated materials of the cushion, thereby simplifying the design and manufacturing process. Specifically, the contour may be determined based on design aesthetics while still providing targeted, differentiated support. Likewise, the cushion may be made of a relatively homogenous material, without the need to differentiate or form composite material regions, thereby reducing the expense thereof. In addition, the shell 2 may be made inexpensively, while avoiding the need for additional, external postural controls such as sacral or lumbar supports.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A backrest comprising:

a shell comprising a first, forwardly facing support surface, said support surface comprising horizontally spaced opposite side regions and a central, spine region positioned between said opposite side regions, said central, spine region comprising vertically spaced upper, middle and lower portions, said upper portion of said central, spine region comprising at least a first protuberance extending forwardly from said support surface, and said lower portion of said central, spine region comprising at least a second protuberance extending forwardly from said support surface, wherein said first protuberance is positioned proximate, and extends downwardly from, a top edge of said shell; and a cushion disposed over said first support surface and comprising a top edge positioned proximate said top edge of said shell, said cushion comprising a second, forwardly facing support surface contour configured to visually disguise said first and second protuberances wherein said second support surface is substantially free of any protuberances overlapping said first and second protuberances.

2. The backrest of claim 1 wherein said at least said first protuberance comprises a plurality of horizontally spaced ribs.

3. The backrest of claim 1 wherein said at least said second protuberance comprises a plurality of horizontally spaced ribs.

4. The backrest of claim 1 wherein said at least said first protuberance has a greater depth than said at least said second protuberance.

5. The backrest of claim 1 wherein said middle portion of said central, spine region is substantially free of any protuberance.

6. The backrest of claim 1 wherein said middle portion of said central, spine region comprises a third protuberance having a lesser depth than said first and second protuberances.

7. The backrest of claim 1 wherein said opposite side regions comprise at least one third protuberance having a lesser depth than said first and second protuberances.

8. The backrest of claim 1 wherein said central, spine region has a width of between about 2.5 and 3.5 inches.

9. The backrest of claim 1 wherein said first and second protuberances extend forwardly of said opposite side regions.

10. The backrest of claim 9 wherein said opposite side regions are substantially free of any protuberance.

11. A chair comprising the backrest of claim 1.

12. The chair of claim 11 wherein said backrest is pivotally connected to a base.

13. The chair of claim 11 further comprising a seat pivotally connected to said base.

14. A backrest comprising:

a shell comprising a first, forwardly facing support surface being more pronounced along upper and lower portions of a central, spine region relative to a middle portion of said central spine region and relative to side regions adjacent said central, spine region, wherein said spine region extends longitudinally from a top to a bottom of said shell; and a cushion disposed over said first support surface and comprising a top positioned proximate said top of said shell, said cushion comprising a second, forwardly facing support surface being free of any corresponding pronounced portions overlying said pronounced upper and lower portions of said central, spine region of said underlying shell.

15. The backrest of claim 14 wherein said top of said cushion covers said top of said shell.

16. The backrest of claim 14 wherein said upper portion comprises a plurality of horizontally spaced ribs.

17. The backrest of claim 14 wherein said lower portion comprises a plurality of horizontally spaced ribs.

18. The backrest of claim 14 wherein said upper portion is more pronounced than said lower portion.

19. The backrest of claim 14 wherein said central, spine region has a width of between about 2.5 and 3.5 inches.

20. A method of supporting a back of a user comprising:

viewing a front surface of a backrest cushion on a seating structure without discerning any apparent, pronounced support along a central, spine region of said front surface;

sitting in said seating structure and pressing against said front surface of said backrest cushion; and providing a pronounced support to at least upper and lower portions of the user's spine, wherein said pronounced support provided to said upper portion is positioned proximate, and extends downwardly from, a top edge of said backrest cushion.

21. The method of claim 20 wherein said providing said pronounced support comprises providing support to said cushion with a shell comprising a first, forwardly facing support surface being more pronounced along upper and lower portions of a central, spine region relative to a middle portion of said central spine region and relative to side regions adjacent said central, spine region.

22. The method of claim 21 wherein said upper portion is more pronounced than said lower portion of said central, spine region.

23. The method of claim 21 wherein said central, spine region has a width of between about 2.5 and 3.5 inches.

24. A backrest comprising:

a shell comprising a first, forwardly facing support surface being more pronounced along a central, spine region relative to side regions adjacent said central, spine region on opposite sides thereof, wherein said first, forwardly facing support surface includes an upper portion positioned proximate, and extending downwardly from, a top edge of said shell; and a cushion disposed over said first support surface, said cushion comprising a second, forwardly facing support surface being free of any corresponding pronounced portions overlying said pronounced central, spine region of said underlying shell.

25. A backrest comprising:

a shell comprising a first, forwardly facing support surface being more pronounced along upper and lower portions of a central, spine region relative to a middle portion of said central spine region and relative to side regions adjacent said central, spine region, wherein said upper portion is positioned proximate, and extends downwardly from, a top edge of said shell; and a cushion disposed over said first support surface.

26. The backrest of claim 1 wherein said top edge of said cushion covers said top edge of said shell.

* * * * *